United States Patent [19]

Copeland

[11] Patent Number: 4,846,397

[45] Date of Patent: Jul. 11, 1989

[54] TAMPER-RESISTANT BOX

[75] Inventor: Judith Copeland, Toronto, Canada

[73] Assignee: Paper P.S. Inc., Toronto, Canada

[21] Appl. No.: 11,787

[22] Filed: Feb. 6, 1987

[51] Int. Cl.[4] ..... B65D 91/00

[52] U.S. Cl. ..... 229/102; 206/366; 206/807; 229/122; 229/154; 229/164; 229/907

[58] Field of Search ..... 206/366, 449, 807; 229/102, 122, 123.2, 125.02, 125.37, 141, 145, 154, 160.1, 164, 183, 907, 23 R; 220/15; 232/2, 15, 31

[56] References Cited

U.S. PATENT DOCUMENTS

| | | | |
|---|---|---|---|
| 772,694 | 10/1904 | Craw | 229/183 |
| 2,358,924 | 9/1944 | Guyer | 229/23 R |
| 2,428,845 | 10/1947 | Guyer | 229/186 |
| 2,562,570 | 7/1951 | O'Brien | 229/125.37 |
| 3,195,798 | 7/1965 | Wilson | 229/183 |
| 3,494,536 | 2/1970 | Henry | 229/122 |
| 3,640,449 | 2/1972 | Bastian | 229/123.2 |
| 4,083,455 | 4/1978 | Keating, Jr. | 206/807 |
| 4,121,755 | 10/1978 | Meseke et al. | 206/366 |
| 4,315,592 | 2/1982 | Smith | 206/366 |
| 4,356,950 | 11/1982 | Benham | 229/125.02 |
| 4,534,489 | 8/1985 | Bartlett | 229/125.37 |
| 4,674,676 | 6/1987 | Sandel et al. | 206/366 |

FOREIGN PATENT DOCUMENTS

| | | | |
|---|---|---|---|
| 14545 | of 1929 | Australia | 229/23 R |
| 383131 | 10/1923 | Fed. Rep. of Germany | 229/23 R |

*Primary Examiner*—Stephen Marcus
*Assistant Examiner*—Gary E. Elkins
*Attorney, Agent, or Firm*—Ostrolenk, Faber, Gerb & Soffen

[57] ABSTRACT

A tamper-resistant box for storing confidential documents has a container for holding these documents. A lid is associated with the container and is moveable from an open position wherein it is remote from the container to a closed position wherein it overlies an opening in the container. A seal is associated with the lid and is breakable upon movement of the lid to the open position to provide evidence of tampering with the box. A slot is located in the container to allow paper documents to be inserted in the container and is concealed by a concealing flap extending over the slot to conceal the contents of the box but to allow paper documents to be passed through the slot and into the box.

3 Claims, 3 Drawing Sheets

FIG. 1
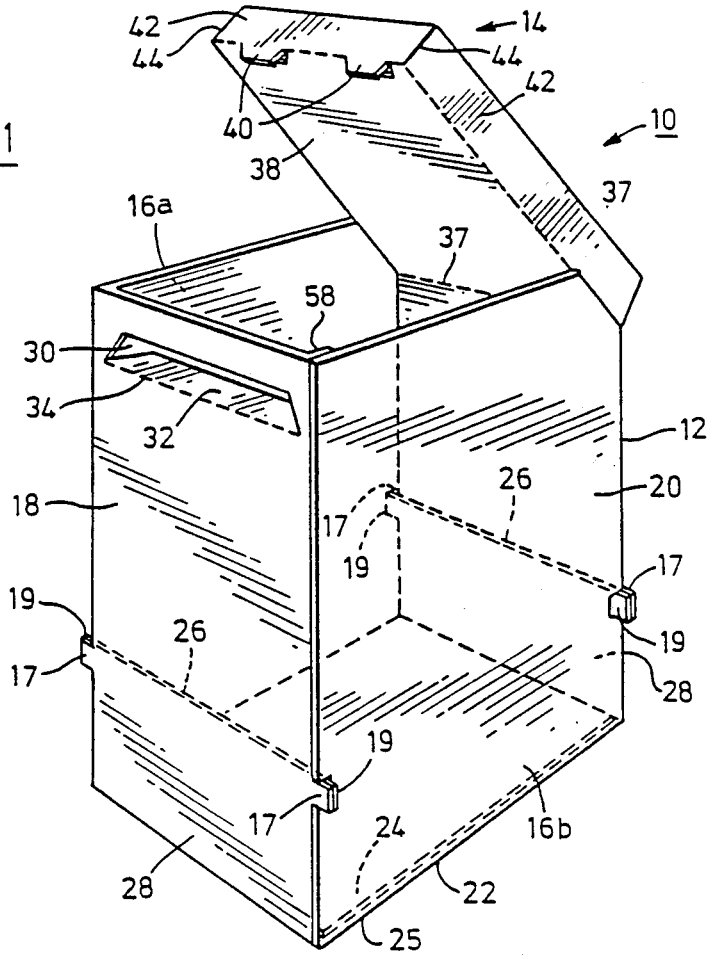
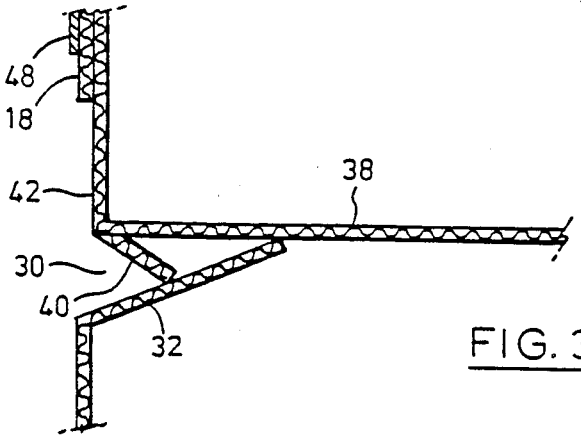
FIG. 3

TAMPER-RESISTANT BOX

This invention relates to a tamper-resistant box.

It is often necessary to dispose of paper documents whose contents are desired to be kept secret. Conventionally, this is done on location by passing the documents through a paper shredder and disposing the shredded documents. This tends to be a tedious, time-consuming chore.

It is an object of the present invention to obviate or mitigate the above-mentioned disadvantages.

Accordingly, the invention provides a tamper-resistant box for storing confidential paper documents. The box comprises a container for holding the documents.

According to the present invention there is provided a tamper-resistant box for storing confidential paper documents, said box comprising:

a container for holding said documents;

a lid associated with said container and moveable from a first position wherein it is remote from said container to a second position wherein it overlies an opening in said container;

a seal associated with said lid, said seal being breakable upon movement of said lid to said first position to provide evidence of tampering with said box;

a slot provided in a wall of said container to allow paper documents to be inserted into said container;

slot concealing means located within said container, said slot concealing means being moveable along a path between open and closed positions, in said open position said slot concealing means allowing documents to be passed into said box and in said closed position said slot concealing means substantially covering said slot to conceal the contents of said box;

biasing means for biasing said slot concealing means towards said closed position; and movement limiting means positioned on said path and extending across a portion of said slot, said movement limiting means contacting said slot concealing means when said slot concealing means is in said closed position to exhibit said slot concealing means from moving along said path beyond said second position and out of said container via said slot.

FIG. 1 is a perspective view from above and to the left of a tamper-resistant box with a lid in an open position;

FIG. 3 is a cross-sectional view along line 3—3 of FIG. 2;

Figure 4:
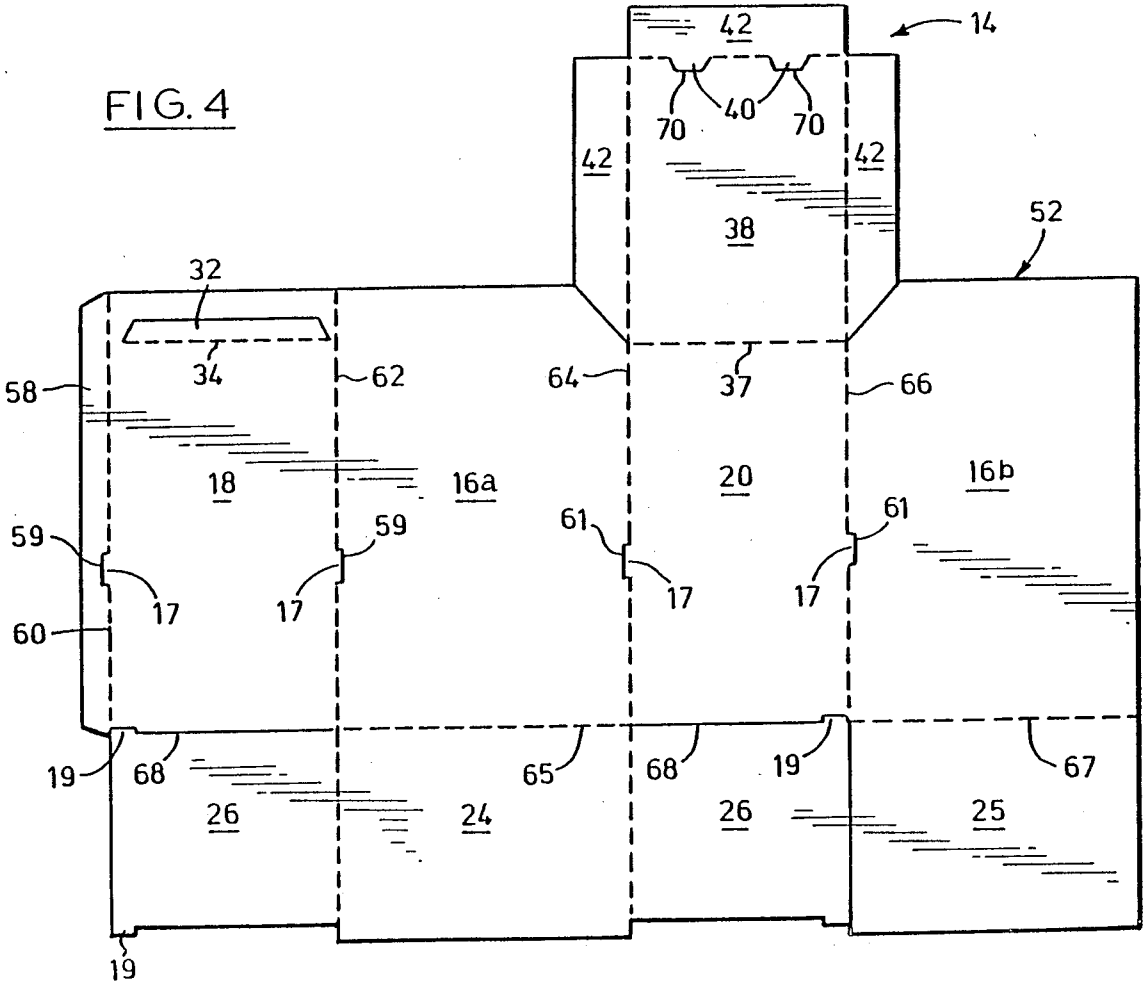
FIG. 4 is a top view of an unassembled blank of the tamper-proof box of FIG. 1.

Referring to FIG. 1, it can be seen that a tamper-resistant box 10 has a container 12 and a lid 14. The container 12 has two side walls 16*a*, 16*b*, a front wall 18, a rear wall 20 and a base 22. The base 22, as can be seen in FIGS. 1 and 4 is made up of two major flaps 24, 25. Two minor flaps 26 extend normally from one of the major flaps 24 and contact and are connected to lower portions 28 of the front 18 and rear walls 20 by interlocking tabs 17, 19 on the front 18 and rear 20 walls and on the minor flaps 26 respectively to increase the rigidity of these walls.

The front wall 18 has a slot 30 therein and a slot-concealing flap 32 extending across the slot 30. The flap 32 is rotatable about a lateral fold line 34 on the front container wall 18. The rear wall 20 has the lid 14 connected thereto which is rotatable about a second lateral fold line 37. This lid 14 comprises a central panel 38 having two tabs 40 extending downwardly from one end thereof and three lid flaps 42 extending upwardly and normally thereto. These lid flaps 42 are connected together at their adjacent edges 44.

Figure 2:
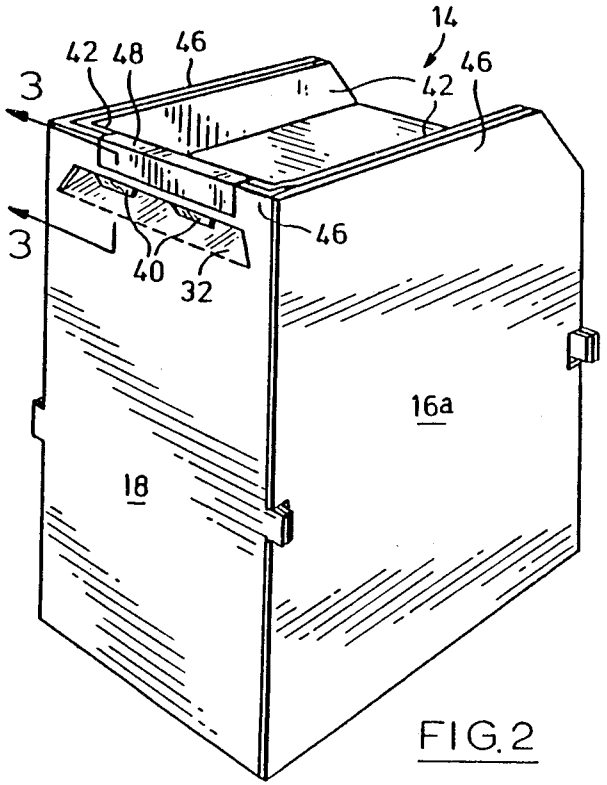
FIG. 2 is a perspective view from above and to the left of the tamper-resistant box of FIG. 1 with the lid in the closed position and a seal located thereon.

In FIG. 2, the lid 14 is shown in a closed position wherein it encloses the container 12. In this position, the lid flaps 42 are adjacent the interior surface of upper portions 46 of the side walls 16*a*, 16*b* and the front wall 18 and are fastened to these walls 16*a*, 16*b*, 18 by adhesive. A seal 48 is folded over the top edge of the front wall 18 and the adjacent lid flap 42 and adheres thereto. As can be seen in FIG. 3, in this position, one of the lid flaps 42 extends across a portion of the slot 30 and pushes the slot-concealing flap 32 downwardly away from the slot 30. The tabs 40 are inclined towards the interior of the container 12 and press downwardly on the slot-concealing flap 32.

FIG. 4 shows a one-piece blank used to be make the tamper-resistant box 10. There are four main panels 52 in seriatum, two of which become side walls 16*a*, 16*b*, one the front wall 18 and the other the rear wall 20 of the container when folded. The front wall 18 has a laterally extending slit 54 therein with inclined slits 56 extending generally normal thereto at either end thereof which are folded about lateral fold line 34 to form the slot 30 and slot concealing flap 32. Adjacent to the front wall is a manufacturer's joint 58. The manufacturer's joint and side wall 16*a* adjacent to the front wall have slots 59 therein which define tabs 17 in the front wall 18. The two side walls 16*a*, 16*b* have slots 61 therein to define tabs 17 in the rear wall 20.

The front wall 18 is defined by fold lines 60, 62, the adjacent side wall 16*a* and major flap 24 are defined by fold lines 62, 64, 65, the rear wall 20 and central panel 38 are defined by fold lines 64, 66 and the other side wall 16*b* is defined by fold line 66, 67.

Depending from one end 68 of the front wall 18 and of the rear wall 20 are minor flaps 26 and depending from one end of each of the side walls 16*a*, 16*b* is a respective major flap 24, 25. The minor flaps 26 are separate from the front and rear walls, but are connected to the adjacent major flap 24. These minor flaps are also provided with tabs 19.

Connected to the rear wall 20 at its other end is the central panel 38 of the lid 14. Slits 70 are cut from the central panel 38 at its upper edge to form tabs 40 and three lid flaps 42 are disposed at the periphery of this central lid panel 38.

Figure 5:
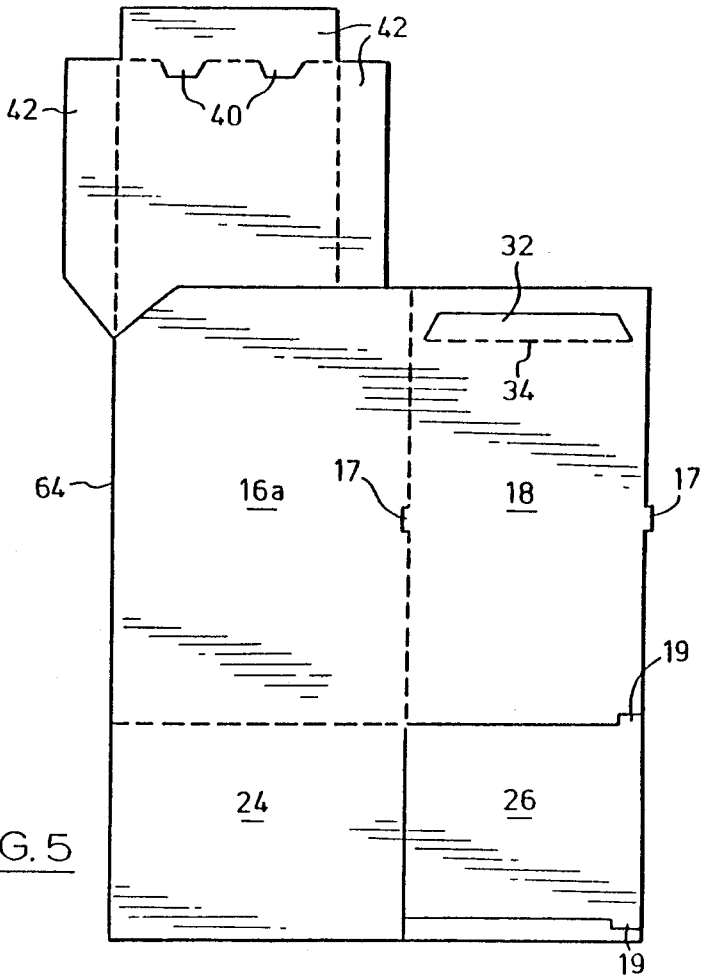
FIG. 5 is a top view of the unassembled blank of FIG. 4 which has been folded along a centre fold line.

To construct the tamper-resistant box, the manufacturer's joint 58 is folded about the fold line 60 and adhesive is applied to the exposed surface thereof. The front wall 18 and adjacent side wall 16*a* are folded over the other side wall 16*b* and rear wall 20 about the fold line 64 into the position shown in FIG. 5. In this position, the manufacturer's joint 58 adheres to the other side wall 16*b* to connect the front wall 18 to the side wall 16*b*. Next the walls 16*a*, 16*b*, 18, 20 are pulled apart to form a rectangular cross section.

Adhesive is applied to the minor flaps 26 and the minor flaps 26 are folded relative to the major flap 24 about the fold lines 62, 64 and the major flap 24 is folded about the fold line 65 so that the tabs 19 interlock with tabs 17 and the minor flaps 26 adhere to the lower inside portion 28 of the front 18 and rear 20 walls. Adhesive is then applied to the other major flap 25 and it is folded about the fold line 67 to contact the first major flap 24. Next the slot-concealing flap 32 is rotated about the fold line 34 so that it extends towards the interior of the container 12. The lid flaps 42 are then folded upwardly and normal to the central lid panel 38 and the tabs 40 are pulled downwardly normal to the central lid panel. The box 10 is then in the position of FIG. 1 and can be assembled into the position of FIG. 2 as described above when required.

In operation, the box 10 is assembled into the configuration of FIG. 2 and confidental documents are passed through the slot 30. The slot-concealing flap 32 bends downwardly to accommodate the documents so that they fall into the container 12. The flap 32 then springs back to its original position. When the box 10 is full, it is destroyed by shredding or any other convenient method.

We claim:

1. A tamper resistant box for storing confidential paper documents, said box comprising:

a container for holding said documents;

a lid associated with said container and movable from an open position wherein it is remote from said container to a closed position wherein it overlies an opening in said container;

a seal associated with the lid, said seal being breakable upon movement of said lid to the open position to provide evidence of tampering with said box;

a slot located in said container to allow paper documents to be inserted in said container;

slot concealing means extending over said slot to conceal the contents of said box, but to allow paper documents to be passed through said slot and into said box; said slot concealing means being rotatably connected to said container and biased towards a position wherein said slot is sealed, but being movable to a position wherein documents can be inserted through said slot and into said box; said slot concealing means comprising a slot-concealed flap formed in said container adjacent to said slot, said flap being rotatable with respect to said container about a laterally extending fold line directly below said slot;

said lid having a central lid panel with lid flaps extending upwardly therefrom, and wherein said container has walls and said lip flaps are aligned with the upper portion of the interior of said walls when said lid is in the closed position; one of said lid flaps extending across a portion of said slot when said lid is in the closed position.

2. The tamper-resistant box of claim 1 wherein said container includes four walls and a base connected to one end of each of said walls, said base comprising at least one major flap and a pair of minor flaps, said minor flaps being connected to opposite sides of said major flap and extending substantially normally therefrom, said minor flaps being juxtaposed with a lower portion of of said walls.

3. The tamper-resistant box of claim 1 wherein said central lid panel has a tab thereon which acts on said concealing means to bias said concealing means away from said lid when said lid is in the closed position.

* * * * *